United States Patent [19]

Likens et al.

[11] 4,056,130

[45] Nov. 1, 1977

[54] VOLUMETRIC BAGGING APPARATUS

[75] Inventors: Robert Likens, Los Angeles; William S. Boehm, Downey, both of Calif.

[73] Assignee: Likens Manufacturing Co., Huntington Park, Calif.

[21] Appl. No.: 663,808

[22] Filed: Mar. 4, 1976 (Under 37 CFR 1.47)

[51] Int. Cl.[2] ..... B65B 1/04

[52] U.S. Cl. ..... 141/67; 141/94; 141/114; 141/DIG. 1; 141/314

[58] Field of Search ..... 141/10, 67, 68, 114, 141/313, 314, 315, 316, 317, 94, DIG. 1, 250–284

[56] References Cited

U.S. PATENT DOCUMENTS 3,120,289 2/1964 Scott ..... 141/315

*Primary Examiner*—Houston S. Bell, Jr.

*Attorney, Agent, or Firm*—Hubbell, Cohen, Stiefel & Gross

[57] ABSTRACT

In a volumetric bagging apparatus for dispensing a predetermined volume of particulate material, such as fertilizer, into a bag position on the apparatus for receipt thereof, a rotating drum fills a clamped empty bag until a magnetic cam comes into controlled magnetic proximity to a first magnetic proximity micro switch. As the magnetic cam passes by the first magnetic micro switch, the then filled bag is released. A second magnetic proximity micro switch may be provided which is positioned after the first magnetic micro switch in the direction of rotation of the drum, with the actuation of the second magnetic proximity micro switch disengaging the drive means for the drum and locking the drum brake, thereby completing the bagging cycle. In this manner, the improved volumetric bagging apparatus is indexed by magnetic actuation. The sequence of operation is initiated by the mounting of an empty bag on a filler spout which produces an actuation signal which releases the drum brake, engages the drum drive and locks the bag securing clamps, the drum rotating around and thereby filling the clamped bag until the magnetic cam comes into the aforementioned controlled magnetic proximity with the first magnetic micro switch. Continuous operation can occur if the next empty bag is in position before the second micro switch is encountered, the drum thereby continuing to rotate, the next bag being secured and the cycle being repeated.

10 Claims, 5 Drawing Figures

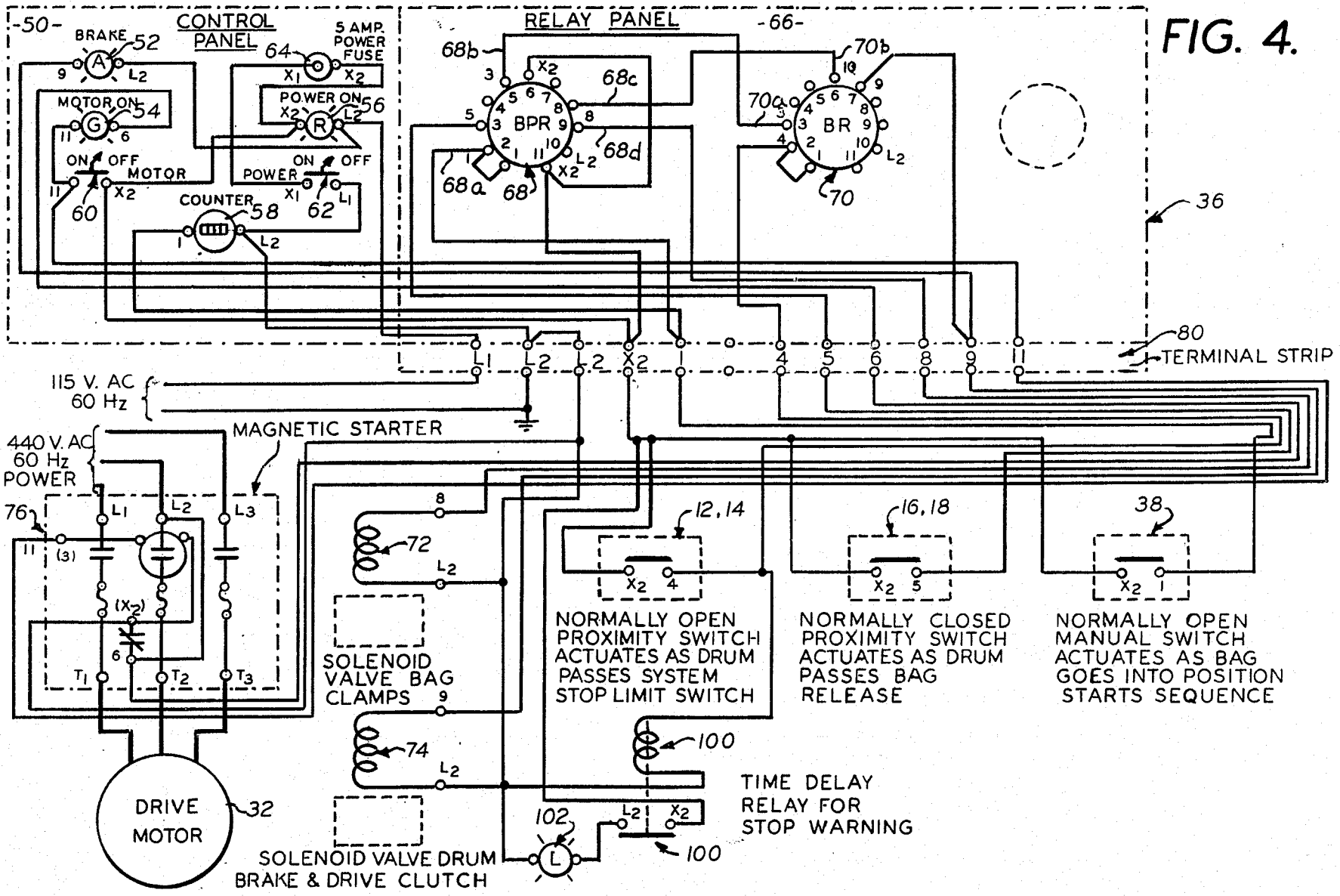
FIG. 4.
36
80
TERMINAL STRIP
38
NORMALLY OPEN MANUAL SWITCH ACTUATES AS BAG GOES INTO POSITION STARTS SEQUENCE
16, 18
NORMALLY CLOSED PROXIMITY SWITCH ACTUATES AS DRUM PASSES BAG RELEASE
12, 14
NORMALLY OPEN PROXIMITY SWITCH ACTUATES AS DRUM PASSES SYSTEM STOP LIMIT SWITCH
100
TIME DELAY RELAY FOR STOP WARNING
102
SOLENOID VALVE DRUM BRAKE & DRIVE CLUTCH
72
74
SOLENOID VALVE BAG CLAMPS
MAGNETIC STARTER
32
DRIVE MOTOR
115 V. AC 60 Hz
440 V. AC 60 Hz POWER
76
-66-
RELAY PANEL
BR
BPR
70
70a
70b
68
68a
68b
68c
68d
-50-
CONTROL PANEL
5 AMP POWER FUSE
64
POWER ON
56
ON POWER OFF
62
COUNTER
58
BRAKE
52
MOTOR ON
54
MOTOR ON OFF
60

SCHEMATIC DIAGRAM

VOLUMETRIC BAGGING APPARATUS

BACKGROUND OF INVENTION

1. Field of the Invention

The present invention relates to volumetric bagging apparatus.

2. Description of the Prior Art

Volumetric baggers are well known. Such baggers automatically dispense a predetermined volume of particulate material into an empty bag positioned on the apparatus for receipt thereof. Conventional prior art volumetric baggers employ a rotating drum which fills a clamped bag during rotation thereof with the rotating drum being indexed by mechanical actuation. The mechanical actuation is accomplished by cams mounted on the drum which come into physical contact with switches for positioning the drum and for releasing the filled bag. An example of such a conventional prior art volumetric bagger is Model No. 395 manufactured by Likens Manufacturing Company of Huntington Park, California. However, such mechanically indexed volumetric baggers may have maintenance and system reliability problems resulting from the use of moving arms and their attendant seals as well as the physical contact and wearing away of the actuator due to such physical contact. These disadvantages of the prior art are overcome by the present invention.

SUMMARY OF THE INVENTION

An improved volumetric bagging apparatus for dispensing a predetermined volume of particulate material, such as fertilizer, into a bag positioned on the apparatus for receipt thereof comprises a magnetic control means for indexing a rotatable drum for positioning the drum and releasing the releasably retained bag when the predetermined volume has been dispensed thereto. The magnetic control means comprises a first magnetic cam mounted on the drum for rotation therewith and a first magnetic proximity switch means, such as a magnetic micro switch, mounted adjacent the rotatable drum for actuation by the first magnetic cam means when the first magnetic cam means is in magnetic proximity therewith. The volumetric bagging apparatus comprises a filler spout for providing the particulate material therethrough to the bag, clamp means for releasably retainably positioning the bag at an exit end of the filler spout for receiving the particulate material therethrough, the rotating drum being rotatably positionable adjacent an entrance end of the filler spout for selectively providing the particulate material to the filler spout during rotation of the drum, brake means for holding the drum against such rotation and drive means for selectively rotatably driving the drum. The mounting of an empty bag in the clamp provides an actuation signal to the control means, the control means releasing the drum brake, activating the drum drive to initiate the drum rotation and locking the clamp in response to the actuation signal. The drum rotates and fills the releasably retained clamped bag until the first magnetic cam means actuates the first magnetic proximity switch means whereby the control means unlocks the clamp and the filled bag is released in response to the first magnetic proximity switch actuation. The first magnetic cam means is positioned on the drum with respect to the first magnetic proximity switch to enable the predetermined volume to be dispensed into the bag after provision of the actuation signal before the first magnetic proximity switch is actuated. A second magnetic proximity switch means, such as a second magnetic proximity micro switch, may be spaced after the first magnetic proximity switch in the direction of rotation of the drum for actuation by the first magnetic cam means when the first magnetic cam means is in magnetic proximity therewith. In such an instance, the drum continues to rotate after actuation of the first magnetic proximity switch until the first magnetic cam means actuates the second magnetic proximity switch whereby the control means deactivates the drum drive means and locks the drum brake to complete the bagging cycle. If desired, the control means may also include means responsive to the mounting of the next empty bag before actuation of the second magnetic proximity switch for disabling the operation of the second magnetic proximity switch and enabling the provision of the actuation signal whereby the drum continues to rotate, thus allowing continuous operation. If desired, a timer may be provided which is initiated when the second magnetic proximity switch is actuated and the subsequent occurrence of a predetermined period of drum inactivity. In such an instance, the timer would activate a signal response, such as an audible or visual signal to indicate the delay in operation of the volumetric bagger.

BRIEF DESCRIPTION OF DRAWINGS

FIG. 4 is a schematic diagram, partially in block, of the magnetic control circuit of the improved volumetric bagging apparatus of FIG. 1.

DETAILED DESCRIPTION OF THE PREFERRED EMBODIMENTS

Figure 1:
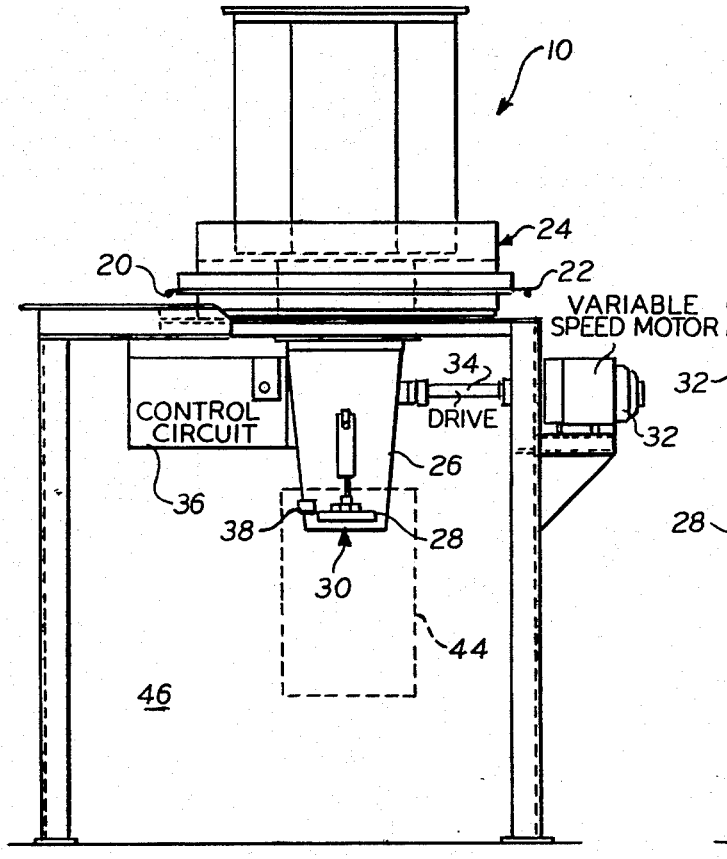
FIG. 1 is a front elevational diagrammatic view of an improved volumetric bagger in accordance with the present invention.
Figure 2:
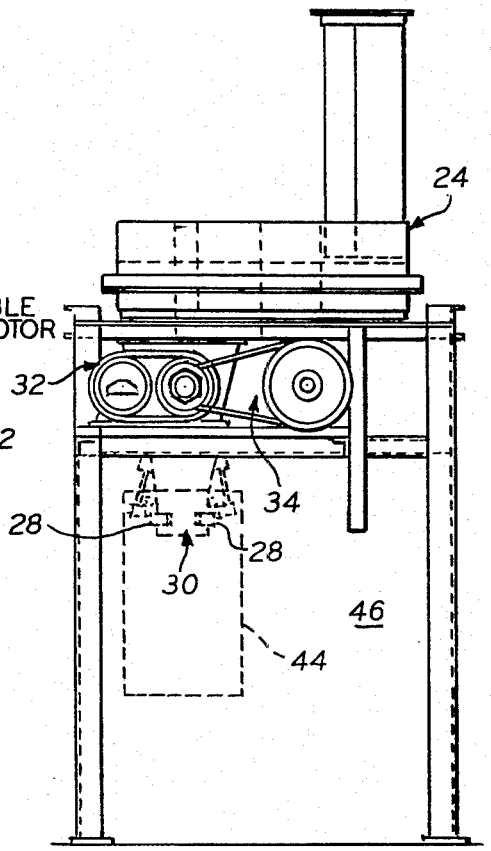
FIG. 2 is a side elevational diagrammatic view of the improved volumetric bagger of FIG. 1.
Figure 3:
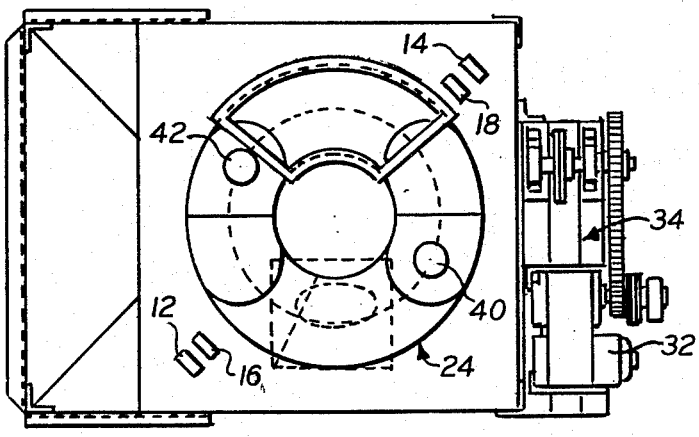
FIG. 3 is a top plan diagrammatic view of the improved volumetric bagger of FIG. 1.
Figure 5:
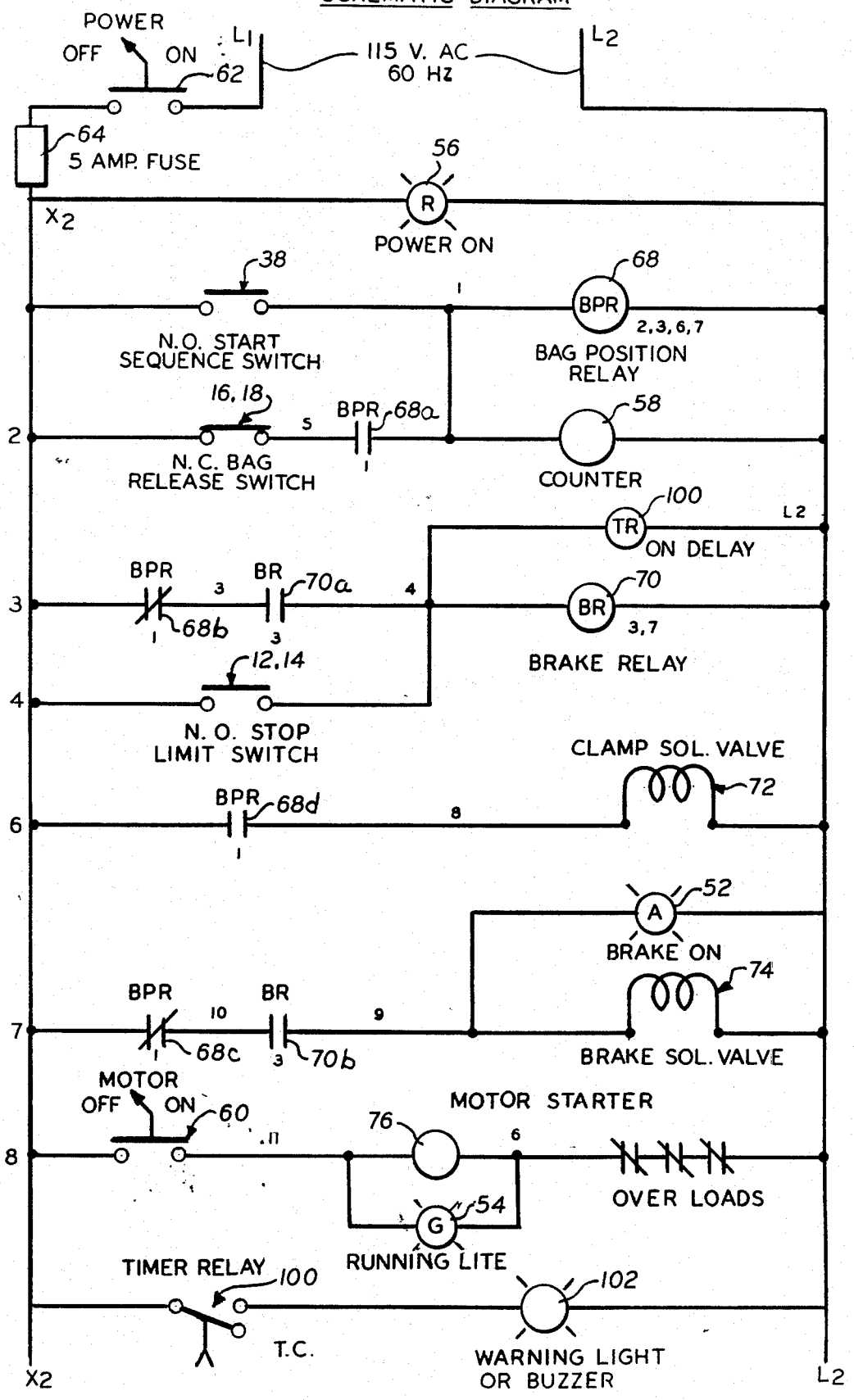
FIG. 5 is a functional relay schematic diagram of the circuit of FIG. 4.

The volumetric bagging apparatus of the present invention is an improvement on conventional volumetric baggers such as the Model No. 395 manufactured by the Likens Manufacturing Company of Huntington Park, California. Referring now to the drawings in detail and initially to FIGS. 1 through 3, these figures illustrate a volumetric bagging apparatus, generally referred to by the reference numeral 10, having a unique improved rotating drum indexing control circuit therefor. Thus, the improved volumetric bagging apparatus 10 of the present invention is illustrated in FIGS. 1 through 5 with the improvements over a conventional volumetric bagging apparatus being essentially confined to the magnetic control circuit 36 with the portions thereof visible in FIGS. 1 through 3, being the magnetic proximity micro switches 12, 14, 16 and 18 visible in FIG. 3, and the magnetic cams 20 and 22 visible in FIG. 1. FIGS. 4 and 5 illustrate the improved magnetic control circuitry 36 for the volumetric bagging apparatus 10 which shall be described in greater detail hereinafter with reference to FIGS. 4 and 5. With respect to the balance of the volumetric bagging apparatus 10 illustrated in FIGS. 1 through 3, the various portions shall only be referred to generally but shall not be described in greater detail hereinafter since these portions are preferably conventional such as available in the Likens Model No. 395 volumetric bagger which, however, employs a different control circuit. Suffice it to say that apart from the unique control circuit and apparatus for the improved volumetric bagger 10 of the present invention, the volumetric bagger 10 includes a conventional rotatable drum 24, a conventional filler spout 26 for the bag, with a lockable bag securing clamp 28 mounted at the exit end 30 of the filler spout 26. In addition, the volumetric bagger 10 includes a conventional variable speed motor 32 which is connected by a conventional drive clutch mechanism 34 to the drum 24 for causing rotation thereof. The volumetric bagger 10 also includes a drum brake (not shown) for stopping the rotation of the drum 24. Lastly, and as will be described in greater detail hereinafter with reference to FIGS. 4 and 5, the volumetric bagger 10 of the present invention preferably includes the magnetic control circuit or system 36 which indexes the rotating drum 24 by magnetic actuation. In addition, preferably mounted on the filler spout 26, adjacent the bag clamp 28 is a conventional micro switch 38 for controlling the operation of the bag clamp 28 as will be described in greater detail hereinafter. The variable speed motor 32, preferably has a variable speed drive so that the operator can change the speed of the motor 32 to suit the size or volume of the bag. Various adaptors can be put in the drum 24 for accommodating different volume bags. As shown and preferred in FIG. 3, the improved volumetric bagger 10 can fill two bags for each revolution with the bag filling apertures 40 and 42 thus being spaced 180° apart, as illustrated in FIG. 3. An empty bag 44 is diagrammatically illustrated by dotted lines in position at the exit end of the filler spout 26 releasably retained in position there by clamps 28. As shown and preferred in FIGS. 1 and 2, the supporting frame of the volumetric bagger 10 is arranged to provide an open area 46 underneath the filler spout 26 sufficient to enable the easy mounting and dismounting of bags 44 for filling by rotation of the drum 24.

Referring now to FIG. 4, the preferred magnetic control circuit or system 36 of the present invention for controlling the operation of the improved volumetric bagger 10 is shown. As shown and preferred in FIG. 4, the magnetic control circuit 36 preferably includes a control panel 50 having a plurality of signal indicators thereon. One such signal indicator is a signal lamp 52 which indicates when the drum brake is on; another such signal indicator is another lamp 54 which indicates when the motor or drum drive is actuated; another signal lamp 56 is provided to indicate when power is being provided; and a counter 58, which is a conventional counter, is preferably provided to indicate the number of bags which have been filled. Of course, counter 58 may be omitted if no such count is desired. In addition, an on/off switch 60 for the motor 32 is provided as well as an on/off switch 62 for the power. Furthermore, as shown and preferred in FIG. 4, the control panel 50 may include a conventional power fuse 64 for the circuit.

The magnetic control system 36 also preferably includes a relay panel 66 which includes a bag position relay 68 and a brake relay 70. As will be described in greater detail hereinafter, the bag position relay 68 and the brake relay 70 are responsive to the various control and actuation signals provided within the preferred magnetic control circuit or system 36. As will also be described in more detail with reference to FIG. 5, the bag position relay 68 has two open contact positions **68*a* and 68*d*, and two closed contact positions 68*b* and 68*c*. The brake relay 70, as will be described in more detail with reference to FIG. 5, has two relevant open contact positions 70*a* and 70*b*. In addition, as shown and preferred in FIG. 4 and as will be described in greater detail hereinafter with reference to FIG. 5, there is a solenoid valve 72 for the bag clamps and a solenoid valve 74 for the drum brake and drive clutch. There is also, preferably, a conventional magnetic starter 76, which is conventional and will not be described in greater detail hereinafter, for the drive motor 32. Lastly, as shown and preferred in FIG. 4, and as previously mentioned with reference to FIGS. 1 through 3, a normally open magnetic proximity switch 12, 14 is provided which is actuated as the drum 24 passes thereover and functions as a stop limit switch; another normally closed magnetic proximity switch 16, 18 is provided which is actuated as the drum 24 passes thereover and provides bag release; and a normally open manual switch 38 is provided which is actuated as the bag goes into position and starts the sequence. Control panel 50 and relay panel 66 are preferably connected through a conventional terminal connector 80 to the solenoid valve 72 for control of the bag clamp, to the solenoid valve 74 for control of the brake and drive clutch, to switches 12, 14, 16, 18, 38 and to magnetic starter 76. As shown and preferred, the power for the drive motor 32 is preferably, by way of example, 440 volts AC, 60 hertz power, and the power for the control panel and relay panel 50, 66**, is preferably, by way of example, a conventional 115 volts AC, 60 hertz power.

Referring now to FIG. 5, a functional schematic diagram to be used in explaining the operation of the control circuit 36 illustrated in FIG. 4 is shown. The preferred sequence of operation under control of the preferred magnetic control circuit or system 36 of the present invention is as follows. As an empty bag 44 is placed in position at the exit end of the filler spout 26, this closes normally open manual switch 38 to start the sequence. The closure of normally open start sequence switch 38 provides an actuation signal which releases the drum brake, engages the drive clutch, and locks the bag securing clamps. Drum 24 then rotates around, filling the clamped bag 44 until the magnetic cams 20, 22 come into controlled magnetic proximity with the first magnetic micro switch 16, 18, respectively. As the magnetic cam 20, 22 passes by the corresponding magnetic micro switch 16, 18, the then filled bags 44 are released, if two bags are filled in one revolution, and the drum 24 preferably continues to turn until the second magnetic micro switch 12, 14 is encountered; that is, until the cam 20, 22 comes into controlled magnetic proximity to the corresponding second micro switch 12, 14. This actuates the second micro switch 12, 14 which thereby disengages the drive clutch and locks the drum brake. This completes the bagging cycle which is now ready to repeat. The various open and closed positions of the bag position relay 68 contacts and brake relay 70 contacts is shown in FIG. 5 with the corresponding portions of the control circuit 36 controlled by the responsive operation of relays 68 and 70 being schematically illustrated in FIG. 5 and readily apparent to one of ordinary skill in the art therefrom. As also shown and preferred in FIGS. 4 and 5, should the operator be in position with the next empty bag 44 as indicated by closure of the normally open manual switch 38, before the second micro switch 12, 14 is encountered or actuated by magnetic cam 20, 22, the drum 24 will continue to rotate, the bag 44 will be secured or clamped, and the bagging cycle will be repeated, thus allowing continuous operation.

As also shown and preferred in FIGS. 4 and 5, if desired, a timer 100 may be provided which is initiated when the second micro switch 12, 14 actuated. In such an instance, after a predetermined period of drum 24 inactivity, as determined by the interval of the timer 100, a signal or alarm 102, such as an audible or visual alarm, would be actuated to indicate occurence of this condition. This timer 100 and alarm 102 may, of course, be omitted without departing from the spirit and scope of the present invention.

By utilizing an improved volumetric bagger in accordance with the present invention, the volumetric bagger system reliability and maintainability will be enhanced.

What is claimed is:

1. In a volumetric bagging apparatus for dispensing a predetermined volume of particulate material into a bag positioned on said apparatus for receipt thereof having filler spout means for providing said particulate material therethrough to said bag, clamp means for releasably retainably positioning said bag at an exit end of said filler spout means for receiving said particulate material therethrough, rotating drum means rotatably positionable adjacent an entrance end of said filler spout means for selectively providing said particulate material to said filler spout during rotation of said drum, brake means for holding said drum against said rotation, and drive means for selectively rotatably driving said drum means; the improvement comprising magnetic control means for indexing said rotatable drum for positioning said drum and releasing said releasably retained bag when said predetermined volume has been dispensed thereto, said magnetic control means comprising a first magnetic cam mounted on said drum means for rotation therewith and a first magnetic proximity switch means mounted adjacent said rotatable drum for actuation by said first magnetic cam means when said first magnetic cam means is in magnetic proximity therewith; said clamp means comprising means responsive to the mounting of an empty bag in said clamp means for providing an actuation signal to said control means; said control means further comprising means responsive to said actuation signal for releasing said drum brake means, activating said drum drive means for initiating said drum rotation and locking said clamp means said first magnetic cam means being mounted on said drum means with respect to said mounted first magnetic proximity switch means for enabling said predetermined volume to be subsequently dispensed into said bag during said drum rotation; said control means responsive means further comprising means responsive to said first magnetic proximity switch means actuation during said drum rotation for unlocking said clamp means and releasing said filled bag.

2. An improved volumetric bagging apparatus in accordance with claim 1 wherein said magnetic control means further comprises second magnetic proximity switch means spaced after said first magnetic proximity switch means in the direction of rotation of said drum means for actuation by said first magnetic cam means subsequent to said actuation of said first magnetic proximity switch means when said first magnetic cam means is in magnetic proximity therewith, said control means responsive means further comprising means responsive to said second magnetic proximity switch means actuation during said drum rotation for deactivating said drum drive means and locking said drum brake means for completing a bagging cycle.

3. An improved volumetric bagging apparatus in accordance with claim 2 wherein said control means responsive means further comprises means responsive to the mounting of the next empty bag before actuation of said second magnetic proximity switch means for disabling the operation of said second magnetic proximity switch means and enabling the provision of said actuation signal, whereby said drum continues to rotate to complete a subsequent bagging cycle for said next empty bag.

4. An improved volumetric bagging apparatus in accordance with claim 2 wherein said control means responsive means further comprises signal means responsive to the actuation of said second magnetic proximity switch means and a subsequent drum inactivity for providing a signal a predetermined interval after said second magnetic proximity switch means actuation and said subsequent drum inactivity.

5. An improved volumetric bagging apparatus in accordance with claim 4 wherein said signal means comprises timing means initiated by said second magnetic proximity switch means actuation for providing a first control signal after said predetermined interval, and alarm means responsive to said first control signal for providing said signal, the subsequent provision of said actuation signal deactivating said timing means.

6. An improved volumetric bagging apparatus in accordance with claim 2 wherein said first and second magnetic proximity switch means comprise magnetic micro switches.

7. An improved volumetric bagging apparatus in accordance with claim 1 wherein said first magnetic proximity switch means comprises a magnetic micro switch.

8. An improved volumetric bagging apparatus in accordance with claim 1 wherein said control means actuation signal responsive means and first magnetic proximity switch actuation responsive means comprises relay means.

9. An improved volumetric bagging apparatus in accordance with claim 2 wherein said control means actuation signal responsive means and first and second magnetic proximity switch actuation responsive means comprises relay means.

10. In a volumetric bagging apparatus for dispensing a predetermined volume of particulate material into a bag positioned on said apparatus for receipt thereof having filler spout means for providing said particulate material therethrough to said bag, clamp means for releasably retainably positioning said bag at an exit end of said filler spout means for receiving said particulate material therethrough, rotating drum means rotatably positionable adjacent an entrance end of said filler spout means for selectively providing said particulate material to said filler spout during rotation of said drum, brake means for holding said drum against said rotation, and drive means for selectively rotatably driving said drum means; the improvement comprising magnetic control means for indexing said rotatable drum for positioning said drum and releasing said releasably retained bag when said predetermined volume has been dispensed thereto, said magnetic control means comprising a first magnetic cam mounted on said drum means for rotation therewith and a first magnetic proximity switch means mounted adjacent said rotatable drum for subsequent actuation by said first magnetic cam means during said drum rotation when said first magnetic cam means is in magnetic proximity therewith for enabling completion of a bagging cycle.

* * * * *